US006336408B1

(12) United States Patent
Parrott et al.

(10) Patent No.: US 6,336,408 B1
(45) Date of Patent: Jan. 8, 2002

(54) COOLING SYSTEM FOR DOWNHOLE TOOLS

(76) Inventors: Robert A. Parrott, 5826 Ettrick Dr., Houston, TX (US) 77035; Haoshi Song, 3130 Summer Bay Dr., Sugar Land, TX (US) 77479; Kuo-Chiang Chen, 1714 Abell Field La., Sugar Land, TX (US) 77478

( * ) Notice: Subject to any disclaimer, the term of this patent is extended or adjusted under 35 U.S.C. 154(b) by 0 days.

(21) Appl. No.: 09/240,955

(22) Filed: Jan. 29, 1999

(51) Int. Cl.[7] ..... F42B 3/00; E21B 7/00

(52) U.S. Cl. ..... 102/312; 102/313; 102/704; 102/705; 166/57; 175/17

(58) Field of Search ..... 102/312, 313, 102/704, 705; 166/57; 175/17

(56) References Cited

U.S. PATENT DOCUMENTS 3,142,336 A * 7/1964 Doscher ..... 166/57
3,444,279 A * 5/1969 Dost ..... 166/57
3,700,050 A * 10/1972 Miles ..... 166/57 X
3,731,893 A * 5/1973 Stalmach, Jr. ..... 102/704
4,024,919 A * 5/1977 Pujol ..... 166/57 X
4,513,733 A * 4/1985 Braun ..... 11/11 X
5,153,369 A * 10/1992 Hardt et al. ..... 102/705 X
6,015,015 A * 1/2000 Luft et al. ..... 166/57 X

* cited by examiner

*Primary Examiner*—Peter A. Nelson
(74) *Attorney, Agent, or Firm*—Trop, Pruner & Hu P.C.

(57) ABSTRACT

Apparatus and method for cooling a component inside a tool includes a container and a plurality of heat sinks positioned in the container. The components are positioned in the container with the heat sinks for maintaining a reduced temperature inside the container. Further, an insulating layer and a reflective layer surround the heat sinks and components to reduce heat transfer. Alternatively, the container can have a hollow wall that encloses the space in which a heat sink material (such as an eutectic material) is disposed. The components to be protected are located in the container. The eutectic material includes a composition having tin and zinc. The insulating layer includes a container that stores a vacuum layer, such as a dewar flask.

19 Claims, 5 Drawing Sheets

COOLING SYSTEM FOR DOWNHOLE TOOLS

BACKGROUND

The invention relates to cooling systems for downhole tools.

A wellbore is typically a hostile environment, with downhole temperatures capable of reaching well over 500° F. Such elevated temperatures can damage heat-sensitive components of tools lowered into the wellbore to perform various activities, such as logging, perforating, and so forth. Examples of such heat-sensitive components include explosives and detonating cords used in a perforating apparatus or batteries and electronic circuitry in other devices.

Conventionally, to avoid damage to heat-sensitive components in tools lowered into wellbores having elevated temperatures, the tools must be quickly inserted and retrieved from the well to perform the desired activities. Generally, this is practical only in vertical wells. In highly deviated or horizontal wells, in which insertion and retrieval of tools are relatively slow processes, the length of time in which the tools are kept in the wellbores at elevated temperatures could cause damage to heat-sensitive equipment.

In some logging tools, dewar flasks have been used to protect heat-sensitive equipment. A dewar flask is generally tubular and contains a vacuum layer that reduces heat transfer. Heat-sensitive components are placed in the inner bore of the dewar flask. By using the dewar flask, the rate of temperature rise is reduced to allow the logging tools to stay downhole longer. However, a need continues to exist for more effective techniques of reducing the rate of temperature rise of components lowered into a wellbore.

SUMMARY

In general, in one embodiment, an apparatus for cooling a component inside a tool includes a heat sink positioned next to the component. An insulation layer surrounds the component to reduce heat transfer to the component.

Other features and embodiments will become apparent from the following description and from the claims.

DETAILED DESCRIPTION

In the following description, numerous details are set forth to provide an understanding of the present invention. However, it is to be understood by those skilled in the art that the present invention may be practiced without these details and that numerous variations or modifications from the described embodiments may be possible.

Figure 1:
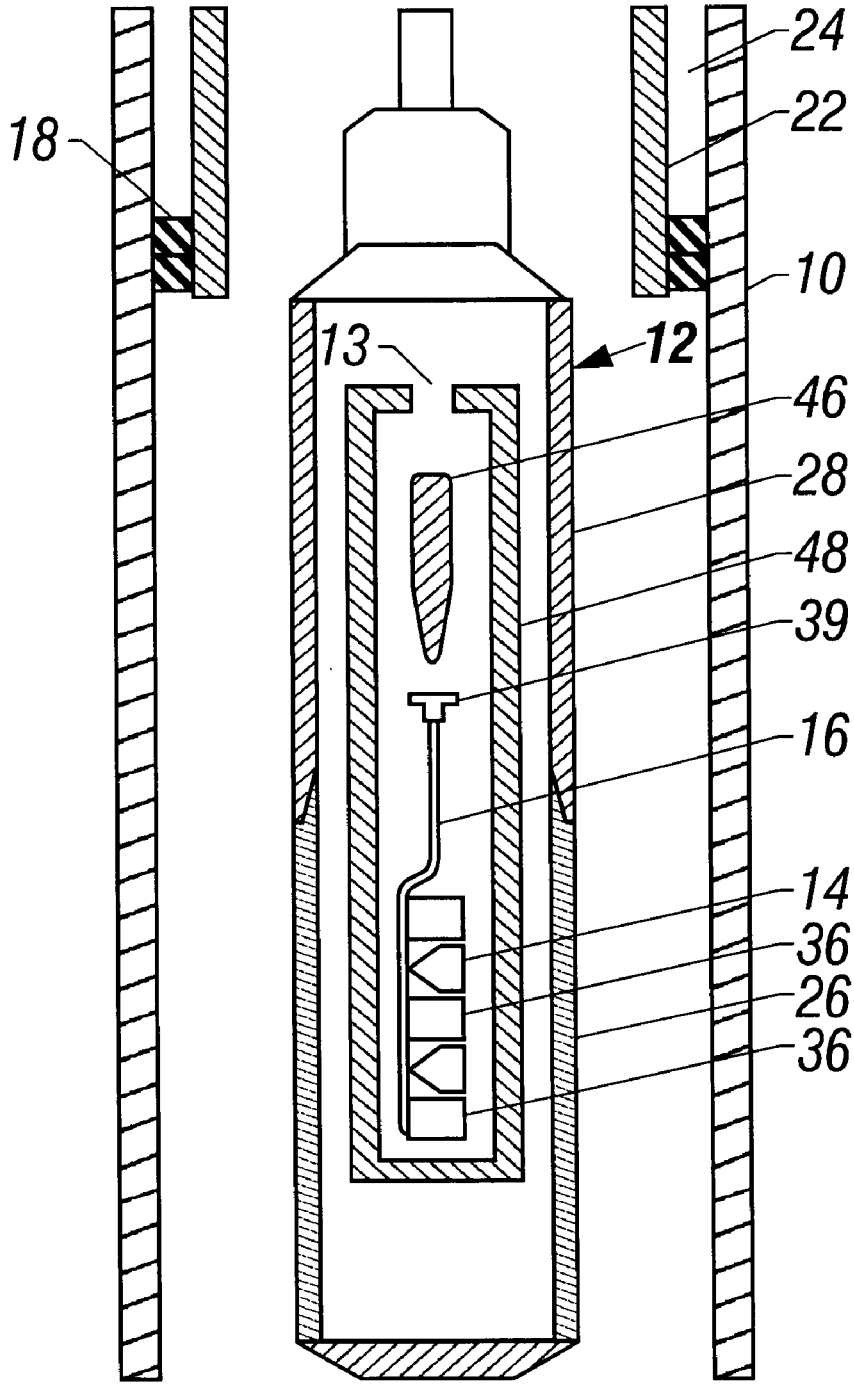
FIG. 1 is a diagram of a perforating apparatus that includes a passive cooling system.

Referring to FIG. 1, a perforating apparatus 12 according to one embodiment includes a "passive" cooling system for protecting heat-sensitive components by maintaining the temperature of the components below the ambient temperature of the wellbore for some period of time. The cooling system keeps the heat-sensitive equipment at a reduced temperature long enough to allow the equipment to operate properly. In further embodiments, other types of downhole tools may be protected using the same or variations of the cooling system.

In one embodiment, the passive cooling system includes layers located inside a loading tube 48 that surround heat-sensitive components (also inside the loading tube 48) to reduce heat conduction, convection and radiation. Heat insulation sheets (e.g., mica layers) may be used to reduce conduction; a vacuum layer (e.g., a dewar flask such as the Pyroflask product made by Vacuum Barrier Corporation of Woburn, Mass.) may be used to reduce conduction and convection; reflective layers (e.g., shiny foils, thin sheet metals, or metal coatings or platings) may be used to reduce radiation; and heat sinks (e.g., chambers containing a eutectic material or liquid) may be used to further slow down the rate of temperature increase of the protected components.

In the illustrated embodiment of FIG. 1, the perforating apparatus 12 is lowered through a tubing 22 and positioned in a cased wellbore. The perforating apparatus 12 contains heat-sensitive components (including shaped charges 14, a detonating cord 16 and a detonator 39) located inside the loading tube 48 that need to be protected from high temperatures. In other types of downhole tools, other types of heat-sensitive components may be present, such as electronic circuitry, batteries, sensors, and so forth.

The perforating apparatus 12 includes a perforating gun 26 coupled to a firing module 28. As further shown in FIGS. 2 and 3, to protect the heat-sensitive components in the perforating apparatus 12, the passive cooling system includes a dewar flask 30 (a tube having a hollow wall filled with vacuum), insulating and reflective layers 32 and 34 made of shiny foils (or sheet metals) and heat insulation material (such as mica), and heat sink bars 36 and a heat sink tube 41 each filled with an eutectic material. The shiny foil or sheet metal used in layers 32 and 34 reflect radiated heat coming from the wellbore through the housing 38 of the perforating gun 26, and the insulation material reduces heat conduction.

The dewar flask 30 is a metal container having a hollow wall 30*a*. A vacuum region 30*b* is drawn inside the wall 30*a* of the dewar flask 30, with the wall extending around the bottom of the flask 30. A space 114 (also filled with vacuum) in the bottom portion of the dewar flask 30 contains a radial spacer 70 that supports the weight of the components in the dewar flask 30.

An evacuation tube 73 is located at the bottom of the dewar flask 30 to allow air to be evacuated from the vacuum chamber inside the wall 30*a* of the dewar flask 30. To further isolate the components in the loading tube 48, a thermal storage material 71 (e.g., nickel, copper, or other suitable materials) is placed at the bottom of the inner bore of the dewar flask 30. The loading tube 48 sits on top of the thermal storage material 71.

Figure 3:
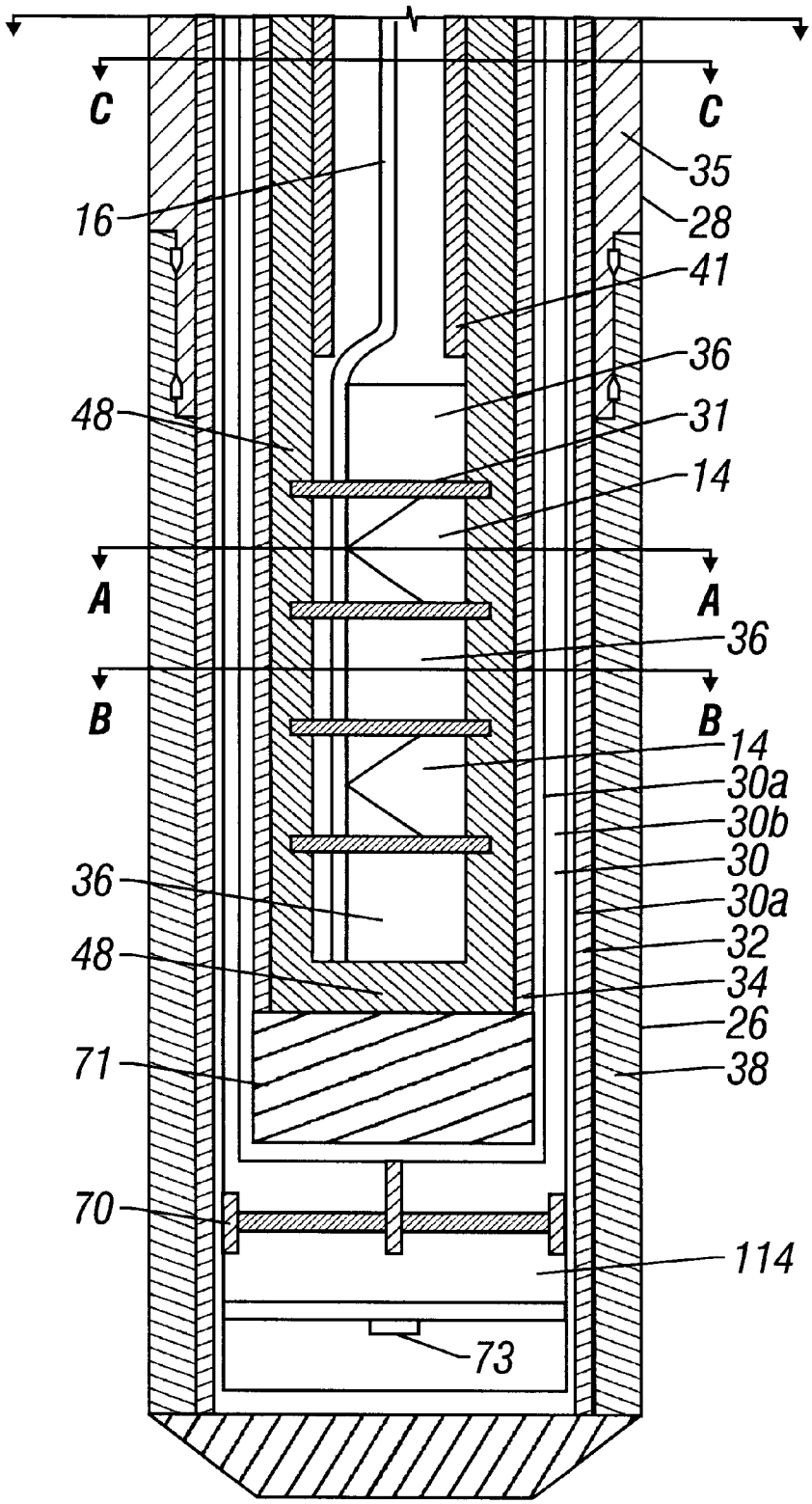

The shaped charges 14 and heat sink bars 36 are located inside the loading tube 48 (FIG. 3). Shelves 31, which can be made of a metallic material, are used to create multiple chambers in the bottom portion of the loading tube 48 for alternately storing the charges 14 and the heat sink bars 36. The inner wall of the loading tube 48 is coated or plated with a thin layer of reflective material, such as chrome, to reflect radiated heat transferred from outside the loading tube 48 and also to improve heat conduction between the heat sink bars 36 and the shaped charges 14. The shelves 31 also aid in transferring heat from the shaped charges 14 to the heat sink bars 36. The heat sink bars 36 draw heat from the detonating cord 16 and shaped charges 14 inside the loading tube 48 to maintain a temperature below that of the wellbore for an extended period of time.

Figure 2:
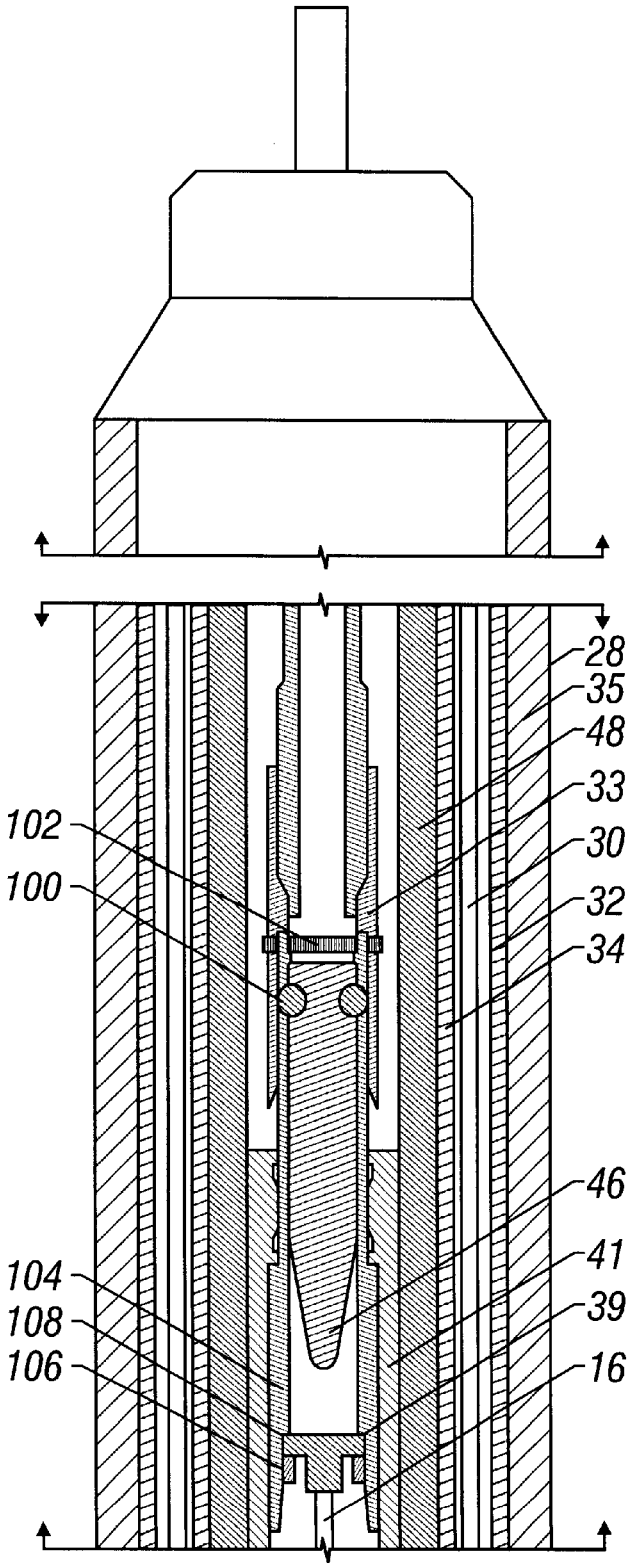
FIGS. 2 and 3 are enlarged views of the perforating apparatus of FIG. 1.

The insulating and reflective layers 32 and 34, the dewar flask 30, and the loading tube 48 each extends upwards along the inner bore of the perforating gun 26 into the bore of the firing module 28. The loading tube 48 is sealed at its top end 13 (FIG. 1) (seal not shown) to prevent well fluid from entering the tube 48. As shown in FIGS. 2 and 3, the detonating cord 16 extends from the shaped charges 14 in the perforating gun 26 into the firing module 28 and is ballistically connected to a percussion detonator 39 in the firing module 28. The percussion detonator 39 is activated when a firing pin 46 is driven into the detonator 39 by hydrostatic pressure generated by fluid pressure above the firing pin 46.

The firing pin 46 is held in position by a release sleeve 33, which holds ball bearings 100 in a circumferential groove in the firing pin 46. When the release sleeve 33 is lifted (by a sufficient force to break a shear pin 102) by a release mechanism (not shown) in the firing module 28 to free the ball bearings 100, well fluid hydrostatic pressure drives the firing pin 46 into the percussion detonator 39 to initiate a detonation wave in the detonating cord 16 to fire the shaped charges 14.

The detonating cord 16, the percussion detonator 39, and the firing pin 46 are protected against excessive heat by enclosing them in the layers 32 and 34 and the dewar flask 30 inside the loading tube 48. In addition, a heat sink tube 41 is attached (e.g., welded) to the inner wall of the loading tube 48 to draw heat from the protected components. The heat sink tube 41 includes a hollow wall that encloses a space into which a eutectic material is injected. The tube 41 is sealed after the eutectic material has been poured into the space.

The detonating cord 16 is enclosed inside the heat sink tube 41. Further, the percussion detonator 39 is fixed inside the tube 41 by a sleeve 104 threadably connected at its top to the heat sink tube 41. The detonator 39 is retained against a shoulder 108 in the sleeve 104 by a retainer ring 106.

The heat sink tube 41 also reduces the temperature of the firing pin 46 to a certain extent as a portion of the firing pin 46 extends into the heat sink tube 41. The heat sink tube 41, like the heat sink bars 36 in the perforating gun 26, draw heat away from the firing pin 46, the detonator 39, and the detonating cord 16 to maintain a reduced temperature inside the heat sink tube 41.

Figure 4A:
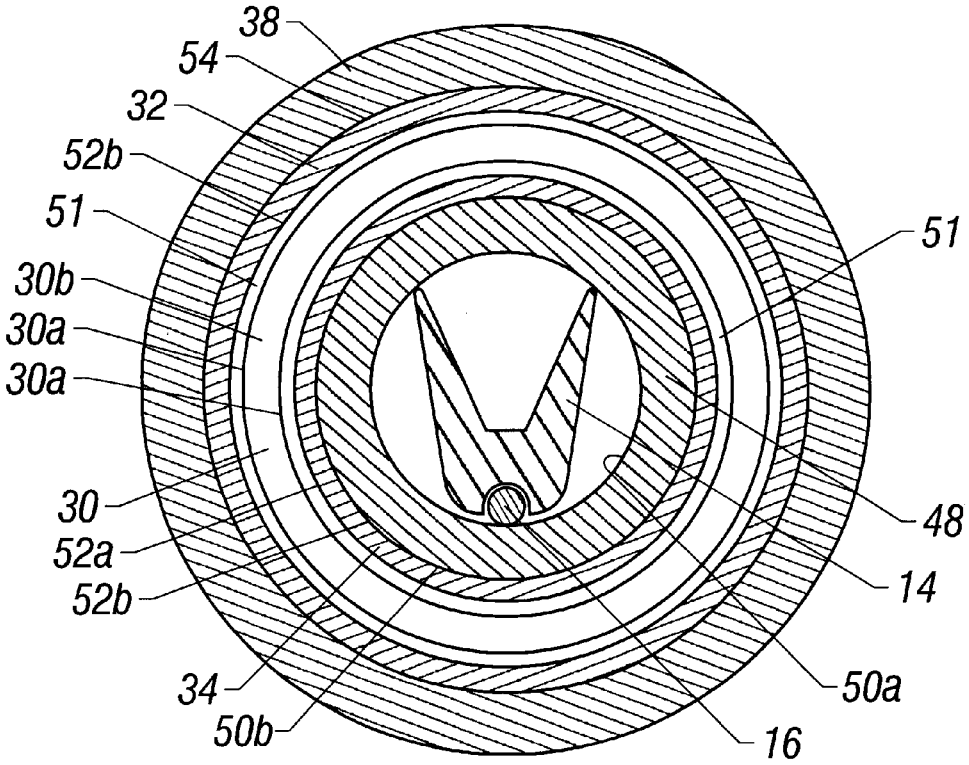
FIGS. 4*a*, 4*b*, and 4*c* are cross-sectional views of different sections of the perforating apparatus of FIG. 1.
Figure 4B:
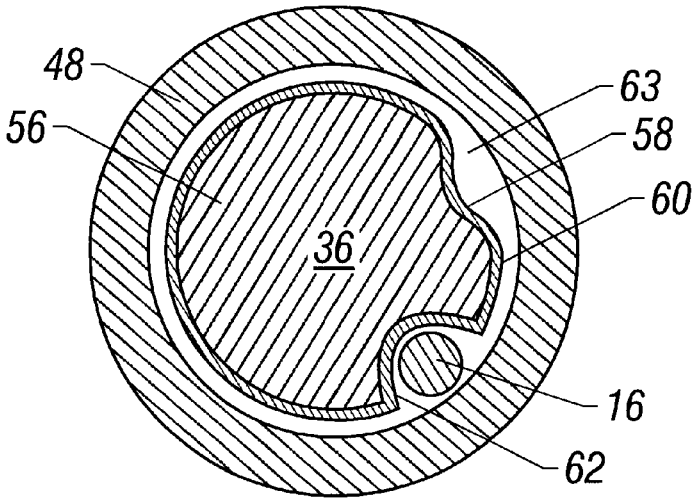
Figure 4C:
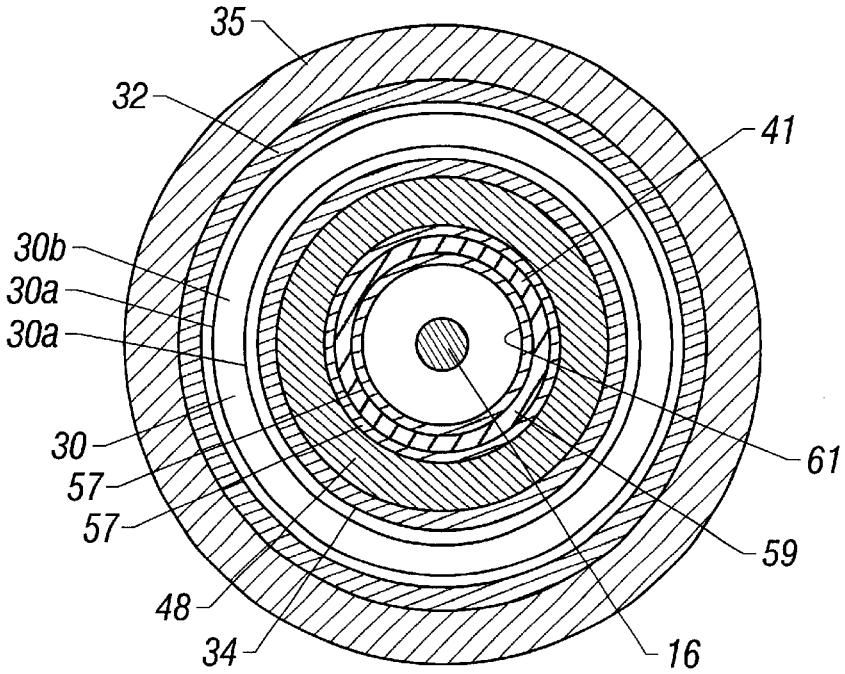

Referring to FIGS. 4*a*–4*c*, cross sections are taken at reference lines A—A, B—B, and C—C (FIG. 3), respectively, along the perforating apparatus 12. In FIG. 4*a*, the outermost layer is the perforating gun housing 38. The insulating and reflective layer 32 is immediately inside the housing 38, followed by the dewar flask 30, the second insulating and reflective layer 34, and the loading tube 48, which encloses the shaped charge 14 and the detonating cord 16.

The dewar flask 30 is a metal tube enclosing a vacuum layer 30*b* inside its wall 30*a*. The vacuum layer 30*b* significantly reduces heat transfer due to convection and conduction.

Each of the layers 32 and 34 can include a number, e.g., four, sub-layers of alternating insulating materials and reflective materials. The insulating sub-layers reduce heat conduction and the reflective sub-layers reduce heat radiation from the wellbore. The insulating materials can be mica sheets, and the reflective materials can be sheets of metal, such as chrome, copper, aluminum, or silver.

In addition, the inner wall 54 of the housing 38 is coated or plated with a reflective material to further reduce radiated heat transfer. For example, the reflective material can be chrome, nickel, or any other suitable material that reduces heat radiation. Other surfaces that are similarly coated or plated with reflective materials are the inner surface 52*a* and external surface 52*b* of the dewar flask 30, and the inner surface 50*a* and external surface 50*b* of the loading tube 48.

In FIG. 4*b*, the inner layers of the cross section of the perforating gun 26 along reference line B—B (FIG. 3) are shown. The heat sink bar 36 positioned inside the loading tube 48 includes an eutectic material 56 (initially in solid form). The external surface of the eutectic material 56 is plated with chrome or some other suitable material. The plating 60 is of sufficient thickness to form a container when the eutectic material 56 melts at higher temperatures once the perforating apparatus 12 is lowered downhole. Alternatively, the plating 60 can represent a fabricated metal container 60 into which eutectic material 56 is initially poured or placed.

The latent heat of fusion of the eutectic material 56 will maintain the temperature at its fusion temperature (or melting temperature) until the eutectic material is totally melted. A longitudinal groove 62 is provided on the outside surface 58 of the heat sink bar 36 to allow the detonating cord 16 to pass through. A second longitudinal groove 63 is provided to compensate for the increase in volume due to heat expansion of the eutectic material 56 and plating 60. The eutectic material can be a cerro metal alloy, such as a tin/zinc composition that is about 91% tin and about 9% zinc by weight manufactured by Cerro Metal Products Corporation. The melting temperature of this tin/zinc composition is approximately 390° F. Alternatively, depending on the desired melting temperature, the ratio of tin to zinc in the composition can be varied.

Alternative heat sinks can also be used. For example, the eutectic material (initially heated to liquid form) can be poured into cavities inside a loading tube having a hollow wall and sealed. Additionally, instead of using eutectic materials, canisters can be provided that store liquids. If liquids are used, then the latent heat of vaporization controls the heat sink effect, that is, the vaporization temperature of the liquid maintains the temperature inside the loading tube 48.

FIG. 4*c* shows the cross-section of the firing module 28 along reference line C—C (FIG. 3). The outermost layer is the housing 35 of the firing module 28. The housing 35 encloses the following layers in order from the outside in: the insulating and reflective layer 32, the dewar flask 30, the insulating and reflective layer 34, and the loading tube 48. The loading tube 48 in turn encloses the heat sink tube 41 that encloses the detonating cord 16 and the percussion detonator 39. The heat sink tube 41 includes a metal wall 57 that encloses an eutectic material 59. A longitudinal bore runs in the center of the heat sink tube 41 through which the detonating cord 16 extends.

The inner wall of the housing 35 is coated or plated with a reflective material to further reduce radiated heat transfer. In addition, as described above, the walls of the dewar flask 30 and the loading tube 48 are coated or plated. The inner wall 61 of the heat sink tube 41 is also coated or plated.

As with the heat sink bars 36, the heat sink tube 41 can be filled with other types of materials, e.g., liquid. In addition, the bore of the dewar flask 30 can be filled with a liquid (so that a portion of the loading tube 48 is immersed in liquid) to further reduce the rate of temperature increase. The liquid in the dewar flask 30 would be sealed inside.

Figure 5:
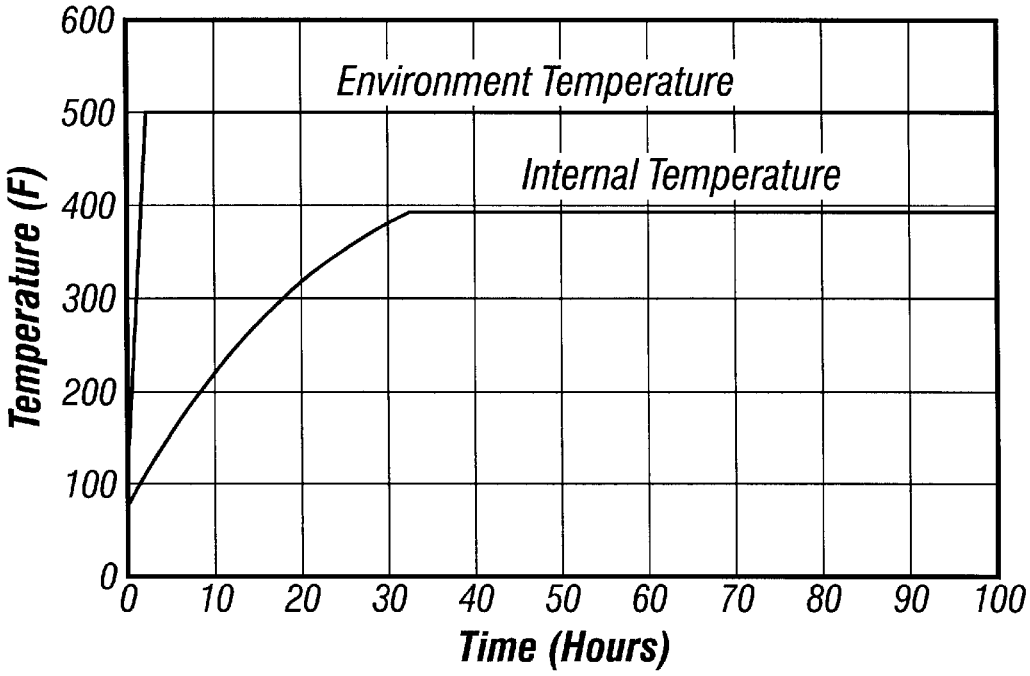
FIG. 5 is a graph showing the temperature rise with respect to time inside the perforating apparatus of FIG. 1 as compared to the ambient temperature of the wellbore.

Referring to FIG. 5, a graph illustrates the approximate temperature behavior inside the loading tube 48 versus the ambient temperature of the wellbore. As shown in the graph, the wellbore temperature quickly rises (within a few hours) to about 500EF as the tool is being lowered downhole. In contrast, the rise in temperature inside the loading tube 48 is more gradual, requiring more than about 30 hours before the internal temperature reaches about the melting temperature of the eutectic material, which is 390EF for a 91%/9% tin/zinc eutectic composition. Thereafter, the internal temperature remains at the eutectic material melting temperature until all the material melts. When that occurs, the internal temperature rises to the environment temperature (not shown on graph). Thus, a period of over 100 hours can be achieved during which the passive cooling system maintains the internal temperature at or below the tin/zinc melting temperature.

Other embodiments are within the scope of the following claims. For example, other components in other types of downhole tools can be protected using the cooling system described. Examples of such components include batteries and electronic circuitry.

What is claimed is:

1. Apparatus for cooling a component inside a tool, comprising:

a heat sink positioned next to the component; and an insulation layer surrounding the component to reduce heat transfer to the component, wherein the insulating layer includes a container that stores a vacuum layer, wherein the container includes a dewar flask.

2. The apparatus of claim 1, wherein the component includes an explosive charge in a perforating apparatus.

3. Apparatus for cooling a component inside a tool, comprising:

a heat sink positioned next to the component; and an insulation layer surrounding the component to reduce heat transfer to the component, wherein the heat sink contains an eutectic material.

4. The apparatus of claim 3, wherein the eutectic material is enclosed in a housing.

5. The apparatus of claim 3, wherein the eutectic material includes a composition having tin and zinc.

6. The apparatus of claim 5, wherein the composition includes about 91% tin and about 9% zinc by weight.

7. Apparatus for cooling a component inside a tool, comprising:

a heat sink positioned nest to the component; and an insulation layer surrounding the component to reduce heat transfer to the component, wherein the insulating layer includes a container that stores a vacuum layer.

8. Apparatus for cooling a component inside a tool, comprising:

a heat sink positioned next to the component;

an insulation layer surrounding the component to reduce heat transfer to the component; and a container surrounding the insulating layer, the container storing a vacuum.

9. The apparatus of claim 8, further comprising a reflective layer surrounding the insulating layer to reflect radiated heat.

10. The apparatus of claim 1, wherein the component includes any one of the following: an explosive charge, a detonating cord, a detonator, and a firing pin.

11. Apparatus for cooling components in a tool, comprising a container having a hollow wall that encloses a space; and a heat sink material disposed in the space, wherein the components are located in the container, wherein the heat sink material includes an eutectic material.

12. The apparatus of claim 11, wherein the eutectic material includes a composition having tin and zinc.

13. The apparatus of claim 11, further comprising:

an insulating layer surrounding the components.

14. The apparatus of claim 11, further comprising:

a reflective layer surrounding the components.

15. An apparatus comprising:

a container defining a chamber;

a component in the chamber;

a heat sink proximal the component; and at least one layer surrounding the component and adapted to reduce heat transfer to the component, wherein the heat sink comprises an eutectic material.

16. The apparatus of claim 15, wherein the at least one layer comprises a heat reflective layer.

17. The apparatus of claim 15, wherein the at least one layer comprises a heat insulating layer.

18. The apparatus of claim 15, further comprising at least another layer, the layers comprising a heat insulating layer and a heat reflective layer.

19. Apparatus for cooling a component in a tool, comprising:

a container that encloses a space; and a heat sink comprising an eutectic material disposed in the space.

* * * * *